US005612089A

United States Patent [19]

Dilmore, Jr. et al.

[11] Patent Number: 5,612,089

[45] Date of Patent: Mar. 18, 1997

[54] METHOD FOR PREPARING DIAPHRAGM FOR USE IN CHLOR-ALKALI CELLS

[75] Inventors: Colonel R. Dilmore, Jr., Jeannette; John O. Snodgrass, Pittsburgh, both of Pa.

[73] Assignee: PPG Industries, Inc., Pittsburgh, Pa.

[21] Appl. No.: 507,174

[22] Filed: Jul. 26, 1995

[51] Int. Cl.[6] ..... B05D 5/00

[52] U.S. Cl. ..... 427/247; 427/340; 427/350; 427/372.2

[58] Field of Search ..... 427/243, 244, 427/247, 337, 340, 350, 372.2

[56] References Cited

U.S. PATENT DOCUMENTS

| | | | |
|---|---|---|---|
| 3,991,251 | 11/1976 | Foster et al. | 428/289 |
| 4,012,541 | 3/1977 | Hirozawa | 427/243 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,173,526 | 11/1979 | Fang | 204/296 |
| 4,184,939 | 1/1980 | Kadija | 204/252 |
| 4,207,163 | 6/1980 | Kadija | 204/253 |
| 4,210,515 | 7/1980 | Patil et al. | 204/266 |
| 4,216,072 | 8/1980 | Kadija | 204/252 |
| 4,253,935 | 3/1981 | Simmons | 204/295 |
| 4,278,524 | 7/1981 | Kadija | 204/252 |
| 4,416,757 | 11/1983 | Kadija | 204/252 |
| 4,606,805 | 8/1986 | Bon | 204/296 |
| 4,665,120 | 5/1987 | Hruska et al. | 524/452 |
| 4,666,573 | 5/1987 | DuBois et al. | 204/98 |
| 4,680,101 | 7/1987 | Darlington et al. | 204/295 |
| 4,720,334 | 1/1988 | DuBois et al. | 204/296 |
| 4,853,101 | 8/1989 | Hruska et al. | 204/296 |
| 5,188,712 | 2/1993 | Dilmore et al. | 204/98 |
| 5,192,401 | 3/1993 | DuBois et al. | 204/98 |

OTHER PUBLICATIONS

T. F. Florkiewicz et al, "Polyramix® A Non–Asbestos Diaphragm Separator", presented at the Chlorine Institute's 31st Plant Managers Seminar, Mar. 9, 1988.

*Primary Examiner*—Kathryn Gorgos
*Attorney, Agent, or Firm*—Irwin M. Stein

[57] ABSTRACT

Asbestos-free diaphragms for chlor-alkali electrolytic cells are prepared by establishing a liquid permeable diaphragm base mat of fibrous synthetic polymeric material on the cathode structure, providing a coating of inorganic particulate material on the base mat, and treating the coated base mat with a nonionic or anionic surfactant. Preferably, the base mat is coated with the inorganic particulate material using a slurry of the inorganic particulate material suspended in an alkali metal halide brine solution containing the surfactant.

26 Claims, No Drawings

METHOD FOR PREPARING DIAPHRAGM FOR USE IN CHLOR-ALKALI CELLS

FIELD OF THE INVENTION

The present invention relates to diaphragms useful in electrolytic cells for the electrolysis of salt solutions, e.g., alkali metal halide solutions, such as sodium chloride brine.

DESCRIPTION OF THE INVENTION

The electrolysis of alkali metal halide brines, such as sodium chloride and potassium chloride brines, in electrolytic diaphragm cells is a well known commercial process. The electrolysis of such brines produces halogen, hydrogen and aqueous alkali metal hydroxide solutions. In the case of sodium chloride brines, the halogen produced is chlorine and the alkali metal hydroxide is sodium hydroxide. The electrolytic cell typically comprises an anolyte compartment with an anode therein, a catholyte compartment with a cathode therein, and a liquid permeable diaphragm which divides the electrolytic cell into the anolyte and catholyte compartments. In the foregoing electrolytic process, a solution of the alkali metal halide salt, e.g., sodium chloride brine, is fed to the anolyte compartment of the cell, percolates through the liquid permeable diaphragm into the catholyte compartment and then exits from the cell. With the application of direct current electricity to the cell, halogen, e.g., chlorine, is evolved at the anode, hydrogen is evolved at the cathode and alkali metal hydroxide (from the combination of sodium ions with hydroxyl ions) is formed in the catholyte compartment.

The diaphragm, which separates the anolyte compartment from the catholyte compartment, must be sufficiently porous to permit the hydrodynamic flow of brine through it, but must also inhibit back migration of hydroxyl ions from the catholyte compartment into the anolyte compartment. In addition, the diaphragm should inhibit the mixing of evolved hydrogen and chlorine gases, which could pose an explosive hazard, and possess low electrical resistance, i.e., have a low IR drop. Historically, asbestos has been the most common diaphragm material used in these so-called chlor-alkali electrolytic cells. Subsequently, asbestos in combination with various polymeric resins, particularly fluorocarbon resins (the so-called polymer-modified asbestos diaphragms), have been used as diaphragm materials.

More recently, due primarily to possible health hazards posed by air-borne asbestos fibers in other applications, attempts have been made to produce asbestos-free diaphragms for use in chlor-alkali electrolytic cells. Such diaphragms, which are often referred to as synthetic diaphragms, are typically made of non-asbestos fibrous polymeric materials that are resistant to the corrosive environment of the operating chlor-alkali cell. Such materials are typically prepared from perfluorinated polymeric materials, e.g., polytetrafluoroethylene (PTFE). Such diaphragms may also contain various other modifiers and additives, such as inorganic fillers, pore formers, wetting agents, ion-exchange resins and the like. Examples of U.S. patents describing synthetic diaphragms include U.S. Pat. Nos. 4,036,729, 4,126,536, 4,170,537, 4,170,538, 4,170,539, 4,210,515, 4,606,805, 4,680,101, 4,853,101 and 4,720,334. The coating of synthetic diaphragms with various inorganic materials is described in U.S. Pat. Nos. 5,188,712 and 5,192,401.

The diaphragm of a chlor-alkali diaphragm cell is an important component of the cell. The permeability of the diaphragm affects directly the operation of the cell, vis-à-vis, the hydrodynamic flow of brine, the control of liquid levels in the anolyte and catholyte compartments of the cell, and the back migration of hydroxyl ions and hydrogen into the anolyte compartment. The diaphragm affects also the ease of cell start-up and the cell voltage and current efficiency of the cell. In addition to the aforedescribed factors, the diaphragm should be capable also of being prepared with cost-effective materials and by economic procedures in order to attain a commercially viable synthetic diaphragm for use in chlor-alkali electrolytic cells.

It has now been discovered that a chlor-alkali electrolytic cell, which uses a synthetic diaphragm and which operates at relatively low voltage and relatively low power consumption, can be achieved by the use of a synthetic diaphragm base mat to which has been applied a topcoat of inorganic particulate material, which in a preferred embodiment, has been deposited from a liquid dispersion medium consisting essentially of alkali metal chloride brine and a nonionic or anionic surfactant. In a preferred embodiment, the surfactant is a nonionic surfactant, the alkali metal chloride brine is sodium chloride brine, and the topcoat comprises one or more inorganic particulate materials, such as finely-divided magnesium silicate-containing clays, attapulgite and hectorite clays, metal oxides, such as zirconium oxide, metal silicates, such as zirconium silicate, and metal hydroxides, such as magnesium hydroxide.

DETAILED DESCRIPTION OF THE INVENTION

In accordance with one embodiment of the present invention, a topcoating of inorganic particulate material is applied to an asbestos-free (synthetic) diaphragm base mat for a chlor-alkali electrolytic cell from a dispersion of the ingredients comprising the topcoat in a liquid (aqueous) dispersing medium consisting essentially of alkali metal chloride brine, e.g., sodium chloride brine, containing a nonionic or anionic surfactant. The alkali metal halide brine is an aqueous solution of the alkali metal halide, sodium chloride, having a concentration of from 100 to 315 grams per liter (gpl), e.g., 200 to 305 gpl. In another embodiment of the present invention, a topcoat of inorganic particulate material is applied to the diaphragm base mat, e.g., from a dispersion of the particulate materials in water, and then the topcoated diaphragm is treated with the brinesurfactant liquid medium. This embodiment requires an extra process step and is therefore economically less preferred.

Other than in the operating examples, or where otherwise indicated, all numbers expressing quantities of ingredients, numerical ranges, or reaction or process conditions used in this description and the accompanying claims are to be understood as modified in all instances by the term "about".

The concentration of the alkali metal salt in the aqueous dispersing (or treating) medium affects the solubility of the surfactant present therein. Generally, the higher the concentration of the alkali metal salt in the brine, the lower is the solubility of the surfactant in the aqueous dispersing medium. Therefore, the brine-containing aqueous dispersing medium will contain also a dispersion, i.e., non-solubilized amounts, of the surfactant. For example, the solubility of the nonionic surfactant used in the examples in an aqueous medium containing 305 gpl sodium chloride is about 0.03 weight percent.

The amount of surfactant used in the aqueous dispersing medium may vary. In accordance with the present invention, an amount of surfactant sufficient to wet the organic fibrous polymer comprising the base mat, e.g., fluorine-containing polymers such as polytetrafluoroethylene, and thereby allow the diaphragm base mat to wick (wet) the brine fed to the electrolytic cell upon cell start-up is used, i.e., a wetting amount. Generally, from 0.2 to 5 weight percent, preferably from 0.5 to 2 weight percent, of the surfactant, based on the weight of the brine dispersing medium is used. Higher amounts of surfactant may be used, but such amounts are not considered economically justified. Preferably, the surfactant is low foaming and have a degree of hydrophobicity which results in it wetting the organic fibrous polymer comprising the base mat.

Surfactant materials that may be used in the process of the present invention include those surfactants that may be represented by the formula, $$R—(OC_2H_4)_m—(OC_3H_6)_n—(OC_4H_8)_p—R_1 \quad \text{I}$$

wherein R is an aliphatic hydrocarbon group, which preferably contains from 6 to 20 carbon atoms, more preferably from 8 to 15 carbon atoms, $—(OC_2H_4)_m—$ represents a poly(ethylene oxide) group, $—(OC_3H_6)_n—$ represents a poly(propylene oxide) group, $—(OC_4H_8)_p—$ represents a poly(butylene oxide) group, $R_1$ is the terminal group, which may be hydroxyl, chloride, $C_1$–$C_3$ alkyl, $C_1$–$C_5$ alkoxy, benzyloxy ($—OCH_2C_6H_5$), phenoxy, phenyl ($C_1$–$C_3$)alkoxy, $—OCH_2C(O)OH$, sulfate, sulfonate or phosphate and the letters m, n and p are each an average number of from 0 to 50, provided that the sum of m, n and p is between 1 and The anionic terminal groups $—OCH_2C(O)OH$, sulfate, sulfonate, and phosphate may be present as a salt, such as a metal, e.g., an alkali metal, ammonium or alkanolamine, e.g., mono-, di-, or triethanolamine, salt, e.g., as the sodium salt. Preferably, m, n and p are each a number of from 0 to 30, with the sum thereof being from 1 to 30; more preferably, m, n and p are each a number of from 0 to 10, with the sum thereof being from 1 to 20, more preferably from 1 to 10. Most preferably, n and p are 0, i.e., the surfactants are ethoxylated aliphatic hydrocarbon materials, e.g., alcohols, i.e., alkanols. The aforedescribed surfactant materials are known to those skilled in the surfactant art and are either available commercially or can be synthesized by known synthesis procedures using commercially available starting materials.

Other surfactant materials that may be used in the process of the present invention include those surfactants that may be represented by formula I, wherein R is the group $(R')_t$—Ph—, wherein R' is an alkyl group containing from 5 to 20 carbons, e.g., 6 to 12 carbon atoms, Ph represents the bivalent or trivalent phenylene group, and the letter t is the integer 0 to 2, preferably 1 or 2.

Further nonionic surfactant materials contemplated for use in the process of the present invention are the copolymers of ethylene oxide and propylene oxide, e.g., ethoxylated polyoxypropylene glycols and propoxylated polyethylene glycols. These materials may be random or block copolymers having a molecular weight of from 1000 to 16,000, and may be capped. The block polyols may be represented by the formulae:

$$HO(C_2H_4O)_a(C_3H_6O)_b(C_2H_4O)_cH \quad \text{II}$$

$$HO(C_3H_6O)_b(C_2H_4O)_a(C_3H_6O)_dH \quad \text{III}$$

wherein the letter b is chosen to provide a polyoxypropylene group of at least 900 molecular weight, e.g., 900–9000 molecular weight, more preferably 950 to 3500. The letter b is therefore equal to or greater than 15. In preparing the surfactants of formula II, the polyoxypropylene group, i.e., the reaction of propylene oxide with propylene glycol, is ethoxylated such that the ethoxy group represented by a and c represent from 10 to 90 percent e.g., 25 to 50 percent of the total weight of the polyol.

In preparing the surfactant of formula III, the polyoxypropylene is ethoxylated so that the amount of ethoxy groups represent from 10 to 90 percent of the total weight of the polyol and then the polyol is capped with propylene oxide, e.g., d is a number of from 1 to 10.

Other polyols may be represented by the formula, $$X\ (OC_2H_4)_q(OC_3H_6)_r(OC_4H_8)_sOX \quad \text{IV}$$

wherein q, r and s are each average numbers of from 0 to 50, provided that the sum of q, r and s is between 1 and 100, and each X is hydrogen, chloride, $C_1$–$C_3$ alkyl, or benzyl. Preferably, X is hydrogen, and q, r and s are each average numbers of from 0 to 30, provided that the sum of q, r and s is between 1 and 50. An example of such nonionic surfactant materials are the PLURONIC® surfactants available from BASF Corporation.

Amphoteric surfactants are also contemplated for use in the process of the present invention. Amphoteric surfactants contain both an acidic and a basic hydrophilic moiety in their structure. The most commercially prominent amphoterics are derivatives of imidazoline. Examples include cocoamphopropionate (CAS#68919-41-5, cocoamphocarboxypropionate (CAS#68919-41-5), cocoamphoglycinate (CAS#68608-65-1), cocoamphocarboxyglycinate (CAS#68647-53-0), cocoamphopropylsulfonate (CAS#68604-73-9), and cocoamphocarboxypropionic acid (CAS#68919-40-4).

Another group of amphoteric surfactants contemplated for use in the process of the present invention include the Betaines and derivatives thereof, such as the Sulfobetaines. Typically, the common betaines may be represented by the formula,

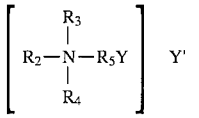

wherein $R_2$ is an alkyl group of from 1 to 20 carbon atoms, e.g., 1–15 carbon atoms, $R_3$ and $R_4$ are each alkyl groups of from 1 to 3 carbon atoms, e.g., methyl, $R_5$ is an alkylene group of from 1 to 3 carbon atoms, Y is the anionic radical comprising the internal salts, e.g., carboxylate ion [—C(O)O—], and sulfonate ion [$—SO_2O—$], Y' is the anionic radical comprising the external salt, e.g., hydrochloride. An example of such a betaine is (carboxymethyl)dodecyldimethylammonium chloride, i.e., $[C_{12}H_{25}—N(CH_3)_2—CH_2COOH]^+Cl—$.

Examples of the nonionic, anionic and amphoteric surfactants described herein (and their commercial sources) can be found listed in the publication, *McCutcheon's Emulsifiers and Detergents*, Volume 1, MC Publishing Co., McCutcheon Division, Glen Rock, N.J.

Preferably, the surfactant material is a nonionic material of formula I wherein R is an aliphatic hydrocarbon group containing from 8 to 15, e.g., 12–15, carbon atoms, n and p are 0, m is a number averaging from 5 to 15, e.g., 9 to 10, and $R_1$ is chloride.

In one embodiment of the present invention, the synthetic diaphragm base mat is treated with the aforedescribed aqueous brine-surfactant dispersion of inorganic particulates after the base diaphragm mat has been formed, and preferably before it has been dried. In the aforementioned process, the synthetic diaphragm is coated with inorganic particulate materials by providing a slurry of the inorganic particulates in the aqueous brine-surfactant dispersing medium and drawing the slurry through the preformed synthetic diaphragm base mat, thereby to deposit inorganic particulates as a coating within and on the exposed surface of the diaphragm. In a further embodiment of the present invention, the synthetic diaphragm base mat is first topcoated with inorganic particulates by drawing an aqueous slurry of the particulates through the base mat, and subsequently treating the coated base mat by drawing a brine-surfactant liquid medium of the nature heretofore described, but without the inorganic particulate ingredients comprising the topcoat, through the coated base mat, thereby to wet the coated base mat with surfactant.

The synthetic diaphragm base mat treated in accordance with the present invention may be made of any non-asbestos fibrous material or combination of fibrous materials known to those skilled in the chlor-alkali art, and may be prepared by art recognized techniques. Typically, chloralkali diaphragms are prepared by vacuum depositing the diaphragm material from a liquid, e.g., aqueous, slurry onto a permeable substrate, e.g., a foraminous cathode. The foraminous cathode is electro-conductive and may be a perforated sheet, a perforated plate, metal mesh, expanded metal mesh, woven screen, an arrangement of metal rods, or the like having equivalent openings typically in the range of from about 0.05 inch (0.13 cm) to about 0.125 inch (0.32 cm) in diameter. The cathode is typically fabricated of iron, iron alloy or some other metal resistant to the operating chloralkali electrolytic cell environment to which it is exposed, for example, nickel. The diaphragm material is typically deposited directly onto the cathode substrate in amounts ranging from about 0.3 to about 0.6 pound per square foot (1.5 to 2.9 kilogram per square meter) of substrate, the deposited diaphragm typically having a thickness of from about 0.075 to about 0.25 inches (0.19 to 0.64 cm).

Synthetic diaphragms used in chlor-alkali electrolytic cells are prepared predominantly from organic fibrous polymers. Useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples thereof include, but are not limited to, fluorine-containing or fluorine- and chlorine-containing polymers, such as polyvinyl fluoride, polyvinylidene fluoride, polytetrafluoroethylene (PTFE), polyperfluoro(ethylenepropylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Polytetrafluoroethylene is preferred.

The organic polymer is typically used in particulate form, e.g., in the form of particulates or fibers, as is well known in the art. In the form of fibers, the organic polymer material generally has a fiber length of up to about 0.75 inch (1.91 cm) and a diameter of from about 1 to 250 microns. Polymer fibers comprising the diaphragm may be of any suitable denier that is commercially available. A typical PTFE fiber used to prepare synthetic diaphragms is a ¼ inch (0.64 cm) chopped 6.6 denier fiber; however, other lengths and fibers of smaller or larger deniers may be used.

Microfibrils of organic polymeric material are also commonly used to prepare synthetic diaphragms. Such microfibrils may be prepared in accordance with the disclosure of U.S. Pat. No. 5,030,403: the disclosure of which is incorporated herein by reference. The fibers and microfibrils of the organic polymeric material, e.g., PTFE fibers and microfibrils, comprise the predominant portion of the diaphragm solids.

An important property of the synthetic diaphragm is its ability to wick (wet) the aqueous alkali metal halide brine solution which percolates through the diaphragm. Perfluorinated ion-exchange materials having sulfonic or carboxylic acid functional groups are typically added to the diaphragm formulation used to prepare the diaphragm to provide the property of wettability.

The preferred ion-exchange material is a perfluorinated ion-exchange material that is prepared as an organic copolymer from the polymerization of a fluorovinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro-(alkylvinyl ether) with the alkyl being an alkyl group containing from 1 to 10 carbon atoms. A description of such ion-exchange materials can be found in U.S. Pat. No. 4,680,101 in column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wet by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the synthetic diaphragm may also include other additives, such as thickeners, surfactants, antifoaming agents, antimicrobial Solutions and other polymers. In addition, materials such as fiberglass may also be incorporated into the diaphragm. An example of the components of a synthetic diaphragm material useful in a chlor-alkali electrolytic cell maybe found in Example 1 of U.S. Pat. No. 5,188,712: the disclosure of which is incorporated herein by reference.

Generally, the synthetic diaphragm contains a major amount of the polymer fibers and microfibrils. As the ion-exchange material is generally more costly than the fibers and microfibrils, the diaphragm preferably comprises from about 65 to about 90 percent by weight combined of the fibers and microfibrils and from about 0.5 to about 2 percent by weight of the ion-exchange material.

The liquid-permeable synthetic diaphragms described herein are prepared commonly by depositing the diaphragm onto the cathode, e.g., a foraminous metal cathode, of the electrolytic cell from an aqueous slurry comprising the components of the diaphragm, whereby to form a diaphragm base mat. Typically, the components of the diaphragm will be made up as a slurry in a liquid medium, such as water. The slurry used to deposit the diaphragm typically comprises from about 1 to about 6 weight percent solids, e.g., from about 1.5 to about 3.5 weight percent solids of the diaphragm components in the slurry, and has a pH of between about 8 and 10. The appropriate pH may be obtained by the addition of alkali metal hydroxide, e.g., sodium hydroxide, to the slurry.

The amount of each of the components comprising the diaphragm may vary in accordance with variations known to those skilled in the art. With respect to the components described in the examples of the present application, and for slurries having percent solids of between 1 and 6 weight percent, the following approximate amounts (as a percentage by weight of the total slurry) of the components in the slurry used to deposit the synthetic diaphragm may be used; polyfluorocarbon fibers, e.g., PTFE fibers,—from 0.25 to 1.5 percent; polyfluorocarbon microfibrils, e.g., PTFE microfibrils,—from 0.6 to about 3.8 percent; ion-exchange material, e.g., NAFION resin,—from about 0.01 to about 0.05 weight percent; fiberglass—from about 0.06 to about 0.4 percent; and polyolefin, e.g., polyethylene, such as SHORT STUFF,—from about 0.06 to about 0.3 percent. All of the aforementioned percentages are weight percentages and are based on the total weight of the slurry.

The aqueous slurry comprising the diaphragm components may also contain a viscosity modifier or thickening agent to assist in the dispersion of the solids in the slurry, e.g., the perfluorinated polymeric materials. For example, a thickening agent such as CELLOSIZE® materials may be used. Generally, from about 0.1 to about 5 percent by weight of the thickening agent can be added to the slurry mixture, basis the total weight of the slurry, more preferably from about 0.1 to about 2 percent by weight thickening agent.

A surfactant may also be added to the aqueous slurry of diaphragm components to assist in obtaining an appropriate dispersion. Typically, the surfactant is a nonionic surfactant and is used in amounts of from about 0.1 to about 3 percent, more preferably from about 0.1 to about 1 percent, by weight, basis the total weight of the slurry. Particularly contemplated nonionic surfactants are chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from about 5 to 15, e.g., 9 to 10. An example of such nonionic surfactant is AVANEL® N-925 surfactant, available from PPG Industries, Inc.

Other additives that may be incorporated into the aqueous slurry of the diaphragm forming components include antifoaming amounts of an antifoaming agent, such as UCON® 500 antifoaming compound, to prevent the generation of excessive foam during mixing of the slurry, and an antimicrobial agent to prevent the digestion of the cellulose-based components by microbes during storage of the slurry. An appropriate antimicrobial is UCARCIDE® 250, which is available from Union Carbide Corporation. Other known antimicrobial agents known to those skilled in the art may be used. Antimicrobials may be incorporated into the slurry in amounts of from about 0.05 to about 0.5 percent by weight, e.g., between about 0.08 and about 0.2 weight percent.

The diaphragm base mat may be deposited from a slurry of diaphragm components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the slurry which has been well agitated to insure a substantially uniform dispersion of the diaphragm components and the slurry drawn through the liquid permeable substrate, thereby to deposit the components of the diaphragm as a base mat onto the substrate.

Typically, the slurry is drawn through the substrate with the aid of a vacuum pump. It is customary to increase the vacuum as the thickness of the diaphragm mat layer deposited increases, e.g., to a final vacuum of about 17 inches (57.5 kPa) of mercury. The liquid permeable substrate is withdrawn from the slurry, usually with the vacuum still applied to insure adhesion of the diaphragm mat to the substrate and assist in the removal of excess liquid from the diaphragm mat. The weight density of the diaphragm mat typically is between about 0.35 and about 0.55 pounds per square foot (1.71–2.68 kg/square meter), more typically between about 0.38 and about 0.42 pounds per square foot (1.85–2.05 kg/square meter) of substrate. The diaphragm mat will generally have a thickness of from about 0.075 to about 0.25 inches (0.19–0.64 cm), more usually from about 0.1 to about 0.15 inches (0.25–0.38 cm).

After removal of the excess liquid present on the base diaphragm mat, and preferably while the mat is still wet, i.e., the diaphragm base mat is not permitted to dry completely, a coating of inorganic particulate material is applied to the exposed surface of the diaphragm mat, i.e., the surface facing the anode or anolyte chamber, in order to regulate the porosity of the diaphragm and aid in the adhesion of the diaphragm mat to the substrate. As is known, one surface of the diaphragm base mat is adjacent to the foraminous cathode structure and therefore, only the opposite surface of the diaphragm mat, i.e., the exposed surface, is available to be coated.

The coating is preferably applied by dipping the diaphragm into a slurry of the coating ingredients and drawing the slurry through the diaphragm under vacuum. The slurry may have a solids content of between about 1 and about 15 grams/liter. e.g., 1–10 or 3–5 grams/liter. This procedure deposits a coating of the desired inorganic particulate materials on the top of the diaphragm mat and/or within the diaphragm mat to a depth a short distance below the formerly exposed surface of the diaphragm mat.

The topcoated diaphragm base mat is then dried, preferably by heating it to temperatures below the sintering or melting point of any fibrous organic material component used to prepare the diaphragm. Drying may be performed by heating the diaphragm at temperatures in the range of from about 50° C. to about 225° C., more usually at temperatures of from about 90° C. to about 150° C. for from about 10 to about 20 hours in an air circulating oven. To assist in the drying of the diaphragm, air is pulled through the diaphragm by attaching it to a vacuum system. As the diaphragm dries and becomes more porous, the vacuum drops. Initial vacuums of from 1 to 20 inches of mercury (3.4 to 67.6 kPa) may be used.

The diaphragms of the present invention are liquid permeable, thereby allowing an electrolyte, such as sodium chloride brine, subjected to a pressure gradient to pass through the diaphragm. Typically, the pressure gradient in a diaphragm electrolytic cell is the result of a hydrostatic head on the anolyte side of the cell, i.e., the liquid level in the anolyte compartment will be on the order of from about 1 to about 25 inches (2.54–63.5 cm) higher than the liquid level of the catholyte. The specific flow rate of electrolyte through the diaphragm may vary with the type and use of the cell. In a chlor-alkali cell the diaphragm should be able to pass from about 0.001 to about 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores. For use in a chlor-alkali cell, the diaphragm will preferably have a permeability similar to that of asbestos-type and polymer modified asbestos diaphragms.

The inorganic, particulate materials used to form the topcoat on the preformed diaphragm base mat can be selected from those materials which are used by those skilled in the chlor-alkali art, to adjust the liquid permeability of the diaphragm. Such materials include refractory materials, such as oxides, borides, carbides, silicates and nitrides of the so-called valve metals, vanadium, chromium, zirconium, niobium, molybdenum, hafnium, tantalum, titanium, tungsten and mixtures thereof. Zirconium-containing materials, such as zirconium oxide, zirconium silicate, hydrous oxides of zirconium and mixtures thereof are preferred. Such inorganic refractory particulates are water-insoluble.

The particle size of such water-insoluble inorganic particulates may vary over a wide range, and will depend on the structure of the preformed diaphragm and the design of the apparatus used to deposit the particulate material on the preformed diaphragm. While not wishing to be bound by any particular particle size, it is reported in the literature that materials with a mass based median equivalent spherical diameter of from about 0.5 to about 10 microns, preferably from about 1.0 to about 5.0 microns, are especially useful. It is to be understood that although the median particle size will be found in this range, individual size fractions with diameters up to about 40 microns and down to about 0.3 microns or less may be represented in the distribution of particle sizes.

In addition to the foregoing described inorganic particulate materials, finely-divided clay minerals may also be used to coat the diaphragm alone or in combination with other materials. Clay minerals, which are naturally occurring hydrated silicates of iron, magnesium and aluminum include, but are not limited to, kaolin, meerschaums, augire, talc, vermiculite, wollastonite, montmorillonite, illite, glauconite, attapulgite, sepiolite and hectorite. Of the clay minerals, attapulgite and hectorite and mixtures thereof are preferred for use in applying a clay coating to the diaphragm base mat. Such preferred clays are hydrated magnesium silicates and magnesium aluminum silicates, which may also be formulated synthetically.

The coating applied to the base diaphragm mat may also contain hydroxides of metal such as iron, zirconium and magnesium. These materials may be incorporated into the aqueous coating slurry by the use of their water-soluble hydrolyzable salts, such as magnesium chloride, zirconium oxychloride and iron chloride, which hydrolyze in the presence of alkali metal hydroxide to form the corresponding water-insoluble metal hydroxides. The topcoat applied to the base diaphragm mat may also contain organic or inorganic fibrous material substantially resistant to the cell environment, e.g., zirconia fibers, PTFE fibers, PTFE microfibers and magnesium oxide fibers.

The topcoat may be applied to the diaphragm base mat using (a) particulate refractory oxide(s) alone, (b) clay mineral(s) alone, or (c) the hydroxides of iron, zirconium and magnesium alone. Mixtures of the components (a) and (b), (a) and (c), (b) and (c), or (a), (b) and (c) may be used. The ratio of such materials may vary widely. Of course, it is understood that one or more of each of the described inorganic particulate materials may be used as the components used to form the topcoat. In a preferred embodiment, a combination of the (a), (b) and (c) components are used, and in a more preferred embodiment the weight ratio of such a mixture is about 1:1:1. The ratio of the various components (a), (b) and/or (c), one to the other when used in the above-described combinations are not critical but may vary.

As discussed, a topcoat is applied to the diaphragm base mat to regulate the porosity of the diaphragm, assist in the adhesion of the mat to the substrate and improve the integrity of the mat. The specific components of the topcoat and the amounts thereof used to form the topcoat will vary and depend on the choice of those skilled in the art. The purpose of the topcoat is to modify the initial porosity of the diaphragm mat so that its porosity is similar to commercially used asbestos and polymer modified asbestos diaphragms. Hence, the precise composition of the topcoat does not represent the core of the invention described herein, since such composition will vary with those practicing the art. The density of the topcoat applied to the base diaphragm mat may vary from about 0.01 to about 0.05 (0.05–0.2 kg/square meter), e.g., 0.03 pounds per square foot (0.02 kg/square meter).

The present invention is more particularly described in the following examples which are intended as illustrative only since numerous modifications and variations therein will be apparent to those skilled in the art.

In the following examples, all reported percentages are weight percents, unless noted otherwise or unless indicated as otherwise from the context of their use. The efficiencies of the laboratory chlor-alkali electrolytic cells are "caustic efficiencies", which are calculated by comparing the amount of sodium hydroxide collected over a given time period with the theoretical amount of sodium hydroxide that would be generated applying Faraday's Law. The reported weight density of the diaphragm mat and the coatings (topcoat) deposited on such mat are based upon the dry weight per unit area of the mat and topcoat.

The diaphragms described in the following examples are commonly too permeable by design to operate with a normal sodium chloride brine feed rate, i.e., they are too permeable to maintain a normal level of liquid in the cell during cell operation. Therefore, it is common to add materials to the anolyte compartment of the cell at start-up and during cell operation in response to the cell's performance to adjust the permeability of the diaphragm so that it will operate at the desired liquid level and other operating parameters, such as low hydrogen levels in the chlorine gas and target caustic efficiencies. The addition of such materials during cell operation is commonly referred to as doping the cell.

In the examples, reported efficiencies, caustic concentration, voltage and power consumption were selected after about one week of operation or such other time when it was considered that the cell had reached semi-stable operating conditions and in order to eliminate the extraneous long term effects of the dopant materials added to the cell to control the permeability of the diaphragm.

In the examples, the dopant materials were added to the anolyte compartment of the cell mixed in sodium chloride brine, usually 100 ml of such brine, which was about a 24.5% aqueous sodium chloride solution. The dopant materials included (1) a 10 weight percent aqueous solution of magnesium chloride—6 hydrate, (2) magnesium hydrogen phosphate—3 hydrate, (3) ATTAGEL 50 clay, (4) acidified ATTAGEL 50 clay, which was prepared by adding 65 grams of the clay to 670 grams of sodium chloride brine (as described above) to which was added 260 grams of 6 Normal hydrochloric acid, (5) aluminum chloride—6 hydrate, and (6) magnesium hydroxide.

EXAMPLE 1

Into a 4 liter plastic beaker fitted with a laboratory Greerco mixer, there were charged 2700 milliliters (ml) of water, 3.55 grams of AVANEL N-925 (90%) nonionic surfactant and 3.2 g UCARCIDE-250 biocide. The mixer was started and 15.08 grams (g) CELLOSIZE ER-52M hydroxyethyl cellulose and 4.3 g of a 4 weight % aqueous sodium hydroxide solution was added to the beaker. The mixer was operated at 50% power until the viscosity of the mixture increased to avoid throwing portions of the mixture out of the beaker. After 5 minutes of such mixing, the mixer power was adjusted to 70% power and 15.59 g of TEFLON Floc [¼ inch(") (0.64 centimeters) (cm) chopped×6.6 denier] polytetrafluoroethylene, 6.67 g chopped PPG DE fiberglass [6.5 micron×⅛" (0.32 cm)] and 3.95 g SHORT STUFF GA-844 polyethylene fiber were added to the mixture. Subsequently, 452 g of an aqueous suspension of TEFLON 60 polytetrafluoroethylene (PTFE) microfibrils (10% PTFE), which was prepared in accordance with the procedure described in U.S. Pat. No. 5,030,403, and 14.46 g of NAFION NR-05 solution (5%) perfluorosulfonic acid ion exchange material were added to the mixture. After about ½ hour total mixing time, the mixer was stopped and the slurry diluted with water to a final weight of 3600 g to give a total suspended solids content of 2.0 weight percent. The resulting slurry was aged for about 1 day and air-lanced for about 20 minutes before use to insure uniform distribution of the contents of the slurry.

A diaphragm mat was deposited using the aforedescribed slurry by drawing the slurry under vacuum through a laboratory steel screen cathode (about 3.5"×3.5" (8.9 cm×8.9 cm) in screen area) so that the fibers in the slurry filtered out on the screen, which was about ⅛" (0.32 cm) thick. The vacuum was gradually increased from 1 inch (3.4 kPA) Of mercury as the thickness of the diaphragm mat increased to about 17 inches (57.5 kPa) of mercury over a twelve minute period. The vacuum was held at 17 inches (57.5 kPa) of mercury for an additional 13 minutes and then the cathode was lifted from the slurry to allow the diaphragm to drain with the vacuum continued for an additional 1 hour. There was about 920 ml of total filtrate collected. The resulting diaphragm mat was estimated to have a weight density of about 0.38 pounds/square foot (lb/sq ft) [1.85 kg/m$^2$] (dry basis) based upon the volume of slurry drawn through the cathode screen.

The diaphragm was topcoated while still damp by drawing a suspension containing 1.67 grams/liter (gpl) each of ATTAGEL 50 attapulgite clay powder, ZIRCOA A zirconia powder and magnesium hydroxide in an aqueous dispersing medium of sodium chloride brine (305 gpl sodium chloride) and 1 weight percent AVANEL® N-925 surfactant, a $C_{12}$–$C_{15}$ Pareth-9 chloride, under vacuum through the diaphragm mat. The vacuum during topcoating was increased gradually and held at 16 inches (54.1 kPa) of mercury until the cathode was removed at 15 minutes. The topcoat weight density was estimated to be 0.015 lb/sq ft (0.6 kg/m$^2$) (dry basis) from the 290 ml of filtrate drawn through the cathode screen. The diaphragm was then placed in a 113° C. oven for 16 hours. A water aspirator was used to maintain air flow through the diaphragm while it was in the oven. The total diaphragm weight after drying was 25.2 grams.

The resulting diaphragm and cathode were placed in a laboratory chlor-alkali electrolytic cell to measure its performance. The cell was operated with an electrode spacing of 3/16" (0.48 cm), a temperature of 194° F. (90° C.) and the current set at 9.0 amperes [144 amperes/sq ft (ASF)]. At cell start-up, brine at a rate of 3 ml/minute was fed to the cell and 0.28 g of the magnesium chloride solution, 0.58 g ATTAGEL 50 clay and 0.76 g aluminum chloride were added to the anolyte compartment of the cell to regulate the diaphragm permeability. At 2 hours and at 4 hours of cell operation, 0.3 g and 0.1 g, respectively, of magnesium hydroxide were added to the anolyte compartment of the cell. During the second day of cell operation, 0.1 g of magnesium hydroxide in 50 ml of sodium chloride brine (305 gpl) was added to the cell. The pH of the brine was adjusted to 2 by dropwise addition of hydrochloric acid before it was added to the cell. During the sixth day of cell operation, 0.2 g of magnesium hydroxide was added to the cell and sufficient hydrochloric acid added to lower the pH of the anolyte to 2. That same day, a second doping with 0.2 g magnesium hydroxide and 0.58 g ATTAGEL 50 clay and lowering of the anolyte pH with hydrochloric acid to 2 was performed. After 7 days of operation, the cell was observed to be operating at 2.84 volts and 96.4% efficiency for a power consumption of 2021 DC kilowatt hours/ton of chlorine produced (KWH/T chlorine). The concentration of sodium hydroxide produced by the cell at this time was 121 gpl.

EXAMPLE 2

Into a 4 liter plastic beaker fitted with a laboratory Greerco Mixer, there were charged 2300 ml of water, 31.2 g. AVANEL N-925 (90%) surfactant and 3.2 g. UCARCIDE-250 biocide. The mixer was started at 50% power. CELLOSIZE ER-52M hydroxyethyl cellulose (15.1 g) was added to the beaker followed by 4.3 g of a 4 weight percent aqueous sodium hydroxide solution. The mixer speed was increased to 70% power and 22.3 g of the NAFION NR-05 solution (5%) perfluorosulfonic acid ion exchange material, 796 g of the TEFLON 60 polytetrafluoroethylene microfibril mixture, 31.4 g of the TEFLON Floc polytetrafluoroethylene; 7.9 g of the PPG DE fiberglass, and 7.0 g of the SHORT STUFF GA-844 polyethylene fiber were added to the beaker. After 22 minutes of total mixing time, the mixer was stopped and the slurry diluted to a final weight of 3600 g to give a total suspended solids content of about 3.5 weight percent. The slurry was allowed to age two days before use. Immediately before use, the slurry was air-lanced for 29 minutes to assure uniform distribution of the ingredients of the slurry.

Using the procedure of Example 1, a diaphragm mat was deposited onto a laboratory steel screen cathode of the type described in Example 1 using the aforedescribed slurry. The vacuum during diaphragm deposition was increased from 1 inch of mercury (3.4 kPa) to about 16 inches of mercury (54.1 kPa) over a ten minute period and then the cathode was lifted from the slurry to allow the diaphragm to drain with the vacuum continued for an additional 30 minutes. The total volume of filtrate collected was 485 ml. The resulting diaphragm mat was estimated to have a weight density of about 0.41 lb/sq ft (2.0 kg/m$^2$) based upon the volume of slurry drawn through the cathode screen.

The diaphragm mat was topcoated while still damp using the same components and method described in Example 1, except that the final vacuum was 18 inches of mercury (60.9 kPa) and the cathode was removed after about 14 minutes. The total filtrate volume collected was 530 ml. The topcoated diaphragm was dried for 16 hours in a 113° C. oven in the manner described in Example 1. The total diaphragm weight after drying was 26.1 g. The topcoat weight was estimated to be 0.023 lb/sq ft (0.11 kg/m$^2$).

The aforedescribed diaphragm and cathode were placed in a laboratory chlor-alkali electrolytic cell to measure its performance under the same cell operating conditions as described in Example 1. At cell start-up, the brine feed rate was 3 ml/minute, and 0.28 g of the magnesium chloride solution, 0.58 g of the ATTAGEL 50 clay and 2.27 g of the aluminum chloride were added to the anolyte compartment of the cell to regulate the diaphragm's permeability. At 3 hours of operation, the brine feed rate was set to 2 ml/minute, and at 5 hours of operation, 0.2 g of magnesium hydroxide was added to the cell. After one day of cell operation, 0.2 g of magnesium hydroxide and 0.58 g of ATTAGEL 50 clay was added to the cell and sufficient hydrochloric acid added to the anolyte to lower its pH to 1.8. After two days of cell operation, the cell was observed to be operating at 2.80 volts and 96.2% efficiency for a power consumption of 1996 DC kilowatt hours/ton of chlorine produced (KWH/T chlorine). The concentration of sodium hydroxide produced by the cell at this time was 118 gpl.

EXAMPLE 3

A slurry of diaphragm materials of the same composition of Example 1 was prepared and used to deposit a diaphragm mat onto a laboratory screen cathode of the type described in Example 1. The slurry was aged for one day before use and air-lanced for 25 minutes to assure uniform distribution of the ingredients of the slurry. After depositing the diaphragm mat, the vacuum was held at 17–19 inches of mercury (57.5–64.2 kPa) for an additional 17 minutes. The cathode was then lifted from the slurry to allow the diaphragm to drain with the vacuum continued. The total volume of filtrate collected was 910 ml. The estimated diaphragm mat weight was 0.38 lb/sq ft (1.9 kg/m$^2$) (dry basis).

The diaphragm was topcoated while still damp by drawing a clay suspension containing 3.3 gpl of ATTAGEL 50 clay powder in aqueous sodium chloride brine (305 gpl sodium chloride) and 1 weight percent AVANEL N-925 (90%) surfactant using the procedure of Example 1. The vacuum during topcoating was increased gradually and held at 18–20 inches of mercury (60.8–67.6 kPa) for twenty minutes, at which time the cathode was removed from the topcoating suspension. The total filtrate volume was 280 ml. The topcoated diaphragm was dried for 16 hours at 113° C. as in Example 1. The topcoat weight was estimated to be 0.02 lb/sq ft (0.09 kg/m$^2$).

The aforedescribed diaphragm was operated in a laboratory chlor-alkali test cell using the cell operating conditions described in Example 1 to measure its performance. The brine feed rate was 3 ml/minute at start-up and at that time 0.28 g of the magnesium chloride solution, 0.57 of the ATTAGEL 50 clay, and 2.27 of the aluminum chloride were added to the anolyte compartment of the cell to regulate the diaphragm permeability. At 2.5 hours of operation, 0.25 g of magnesium hydroxide was added to the cell and the brine feed rate lowered to 2 ml/minute. After 5 days of operation, 0.40 g of magnesium hydroxide was added to the cell and sufficient hydrochloric acid added to lower the anolyte pH to 1. After 8 days of cell operation, the cell was observed to be operating at 2.84 volts and 97.4% efficiency for a power consumption of 2001 KWH/T chlorine. The concentration of sodium hydroxide produced by the cell at this time was 111 gpl.

EXAMPLE 4

A slurry of diaphragm materials was prepared using the ingredients and amounts described in Example 2 except that 35.2 g of the TEFLON FLOC polytetrafluoroethylene and 4.0 g of the PPG DE fiberglass were used. After all of the diaphragm ingredients were added, mixing was continued for an additional 17 minutes and the slurry was diluted to a final weight of 3600 grams to give a total suspended solids content of about 3.5 weight percent. The slurry was allowed to age for 3 days before use. Immediately before use, the slurry was air lanced for 20 minutes to assure uniform distribution of the ingredients in the slurry.

A diaphragm mat was deposited on a laboratory steel screen cathode of the type described in and using the procedure of Example 1. The vacuum was increased from 1 inch of mercury (3.4 kPa) to 17 inches of mercury (57.5 kPa) over a 9 minute period. The deposition vacuum was maintained at 17–20 inches of mercury ( 57.5–67.6 kPa) for an additional 20 minutes while the deposition continued. After 29 minutes total deposition time, the cathode was lifted from the slurry to allow the diaphragm to drain with the vacuum continued. The total volume of filtrate collected was 470 ml. The diaphragm mat weight was estimated to be 0.39 lb/sq ft (1.9 kg/m$^2$).

The diaphragm was topcoated while still damp with a topcoating suspension having the composition described in Example 1. The vacuum during topcoating was increased gradually and held at 18–22 inches of mercury (60.8–74.4 kPa) until the cathode was removed after 43 minutes. The total filtrate volume was 530 ml. The topcoated diaphragm was dried for 16 hours at 113° C. as described in Example 1. The topcoat weight was estimated to be 0.028 lb/sq ft (0.14 kg/m$^2$).

The above diaphragm was operated in a laboratory chlor-alkali electrolytic cell to measure its performance using the cell operating conditions described in Example 1. The brine feed rate at start-up was 3 ml/minute and on start-up 0.14 g of the magnesium chloride solution, 0.29 g of ATTAGEL 50 clay and 2.27 of aluminum chloride were added to the anolyte compartment of the cell to regulate the diaphragm's permeability. After 15 minutes of cell operation, the brine feed rate was set to 2 ml/minute. After 1 day of cell operation, the brine feed rate was increased to 3 ml/minute for 1 hour and then the anolyte pH was lowered to 2.0 with hydrochloric acid and 0.30 g of magnesium hydroxide was added to the cell. The brine feed rate was lowered to 2 ml/minute 3 hours after doping with the magnesium hydroxide. After 3 days of operation, the cell was observed to be operating at 2.80 volts and 96.2% efficiency for a power consumption of 1996 KWH/T chlorine. The concentration of sodium hydroxide produced by the cell at this time was 113 gpl.

Comparative Example 1

Into a 4 liter plastic beaker fitted with a laboratory Greerco mixer, there were charged 2750 milliliters (ml) of water, 15.08 grams (g) CELLOSIZE ER-52M hydroxyethyl cellulose, 4.3 g of a 4 weight % aqueous sodium hydroxide solution, 3.55 grams of AVANEL N-925 (90%) non-ionic surfactant and 3.2 grams of UCARCIDE-250 biocide. The mixer was operated at 50% power until the viscosity of the mixture increased to avoid throwing portions of the mixture out of the beaker. After 6 minutes of such mixing, 18.35 g of TEFLON Floc [¼" inch (") (0.64 centimeters) (cm) chopped×6.6 denier polytetrafluoroethylene), 7.86 g chopped PPG DE fiberglass [6.5 micron×⅛" (0.32 cm)] and 4.66 SHORT STUFF GA-844 polyethylene fiber were added to the mixture and the mixer power adjusted to 70% power. After 15 minutes of such mixing, 532 g of an aqueous suspension of TEFLON 60 polytetrafluoroethylene (PTFE)

microfibrils (10% PTFE), which was prepared in accordance with the procedure described in U.S. Pat. No. 5,030,403, and 14.9 g of NAFION NR-005 solution (5%) perfluorosulfonic acid ion exchange material were added to the mixture. The mixture was stirred for about ½ hour and then diluted with water to a final weight of 3600 g. The resulting slurry was aged for about 1 day and air-lanced for about 30 minutes before use to insure uniform distribution of the contents of the slurry.

A diaphragm mat was deposited onto a laboratory steel screen cathode of the type described in Example 1 using the aforedescribed slurry and the procedure of Example 1. The final vacuum was about 17 inches (57.5 kPa) of mercury. There was about 970 ml of slurry drawn through the cathode screen. The resulting diaphragm mat was estimated to have a weight density of about 0.4 lb/sq ft (2.0 kg/m$^2$). A topcoat was vacuum deposited on the diaphragm mat from a 10 gpl suspension of ATTAGEL 50 attapulgite clay in pH 5 sodium chloride brine containing about 24.5% NaCl. The topcoat weight density was estimated to be 0.05 lb/sq ft (0.25 kg/m$^2$). The topcoated diaphragm was placed in a 115° C. oven overnight and then installed in a laboratory chlor-alkali electrolyte cell for performance testing. The cell was operated with an electrode spacing of ⅛ inch (0.32 cm), a temperature of 194° F. (90° C.) and the current set at 9.0 amperes [144 amperes/sq ft (ASF)]. At cell start-up, brine containing 0.5 g ATTAGEL 50 clay and 5 ml of magnesium chloride solution was added to the cell. During the second and third days of cell operation, 0.5 g of ATTAGEL 50 clay was added to the cell. After six days of cell operation, the test cell was observed to be operating at 2.98 volts and 95.4% efficiency for a power consumption of 2144 DC KWH/T chlorine produced. The concentration of sodium hydroxide produced by the cell at this time was 112 gpl.

A summary of the performance of the test cells of the Examples including the concentration of the NaOH produced by the cells are tabulated in Table 1.

TABLE 1

| EXAMPLE | CELL VOLTAGE | PRODUCT NaOH, gpl | CELL EFFICIENCY | POWER DC KWH/T |
|---|---|---|---|---|
| 1 | 2.84 | 121 | 96.4 | 2021 |
| 2 | 2.80 | 118 | 96.2 | 1996 |
| 3 | 2.84 | 111 | 97.4 | 2001 |
| 4 | 2.80 | 113 | 96.2 | 1996 |
| Comp. 1 | 2.98 | 112 | 95.4 | 2144 |

The data of Table 1 shows that the use of a sodium chloride brine-nonionic surfactant AVANEL N-925) dispersing medium to apply the topcoat to the diaphragm base mat unexpectedly resulted in lower cell voltages and higher cell efficiencies than in the comparative example in which the topcoat was applied from a brine-dispersing medium.

Although the present invention has been described with reference to the specific details of particular embodiments thereof, it is not intended that such details be regarded as limitations upon the scope of the invention except as and to the extent that they are included in the accompanying claims.

We claim:

1. A method for forming an electrolyte-permeable asbestos-free diaphragm on a foraminous cathode structure for use in a chlor-alkali electrolytic cell, comprising:

(a) forming on said cathode structure from a liquid slurry a liquid permeable diaphragm base mat of asbestos-free material comprising fibrous synthetic polymeric material resistant to the chlor-alkali cell environment and ion-exchange material, (b) contacting said diaphragm base mat with an aqueous alkali metal halide brine containing a wetting amount of a surfactant selected from the group consisting of nonionic, anionic and amphoteric surfactants that wet the fibrous synthetic polymeric material, and (c) drying the resultant diaphragm.

2. The method of claim 1 wherein the concentration of alkali metal halide in the brine is from 100 to 315 grams per liter.

3. The method of claim 1 wherein from 0.2 to 5 weight percent of surfactant is present in the brine.

4. The method of claim 1 wherein the surfactant is selected from amphoteric surfactants and surfactants represented by one of the following formulae:

$$R—(OC_2H_4)_m—(OC_3H_6)_n—(OC_4H_8)_p—R_1 \quad (1)$$

$$HO(C_2H_4O)_a(C_3H_6O)_b(C_2H_4O)_cH \quad (2)$$

$$HO(C_3H_6O)_b(C_2H_4O)_a(C_3H_6O)_dH \quad (3)$$

$$X(OC_2H_4)_q(OC_3H_6)_r(OC_4H_8)_sOX \quad (4)$$

wherein R is an aliphatic hydrocarbon group containing from 6 to 20 carbon atoms or the group $(R')_t$—Ph—, wherein R' is an alkyl group containing from 5 to 20 carbon atoms, Ph is the phenylene group, and t is an integer of from 0 to 2; $R_1$ is a terminal group selected from hydroxyl, chloride, $C_1$–$C_3$ alkyl, $C_1$–$C_5$ alkoxy, benzyloxy, phenoxy, phenyl($C_1$–$C_3$)alkoxy, —$OCH_2C(O)OH$, sulfate, sulfonate or phosphate; the letters m, n and p are average numbers of from 0 to 50, provided that the sum of m, n and p is between 1 and 100; b is a number that provides a polyoxypropylene group of at least 900 molecular weight, a and c in formula (2) are numbers such that the ethoxy groups represent from 10 to 90 percent of the total weight of the surfactant of formula (2); a in formula (3) is chosen such that the ethoxy group represents from 10 to 90 percent of the total weight of the surfactant of formula (3) and d is a number of from 1 to 10; each X is hydrogen, chloride, $C_1$–$C_3$ alkyl or benzyl; and the letters q, r and s are each average numbers of from 0 to 50, provided that the sum of q, r and s is between 1 and 100.

5. The method of claim 4 wherein R is an aliphatic hydrocarbon group containing from 8 to 15 carbon atoms, n and p are 0, m is a number from 5 to 15, and $R_1$ is chloride.

6. The method of claim 4 wherein from 0.2 to 5 weight percent of surfactant is present in the brine.

7. The method of claim 1 wherein a coating of inorganic particulate material is applied to the diaphragm base mat by drawing a slurry of inorganic particulate material in an aqueous dispersing medium consisting essentially of the alkali metal halide brine and the surfactant through the base mat.

8. The method of claim 7 wherein the alkali metal halide brine is sodium chloride brine having a concentration of from 100 to 315 gpl sodium chloride.

9. The method of claim 8 wherein the surfactant is a nonionic surfactant and is present in the brine in amounts of from 0.2 to 5 weight percent.

10. The method of claim 9 wherein the nonionic surfactant is represented by the following formula:

$$R—(OC_2H_4)_m—(OC_3H_6)_n—(OC_4H_8)_p—R_1 \quad (1)$$

wherein R is an aliphatic hydrocarbon group containing from 8 to 15 carbon atoms; $R_1$ is hydroxyl, chloride, $C_1$–$C_3$ alkyl, $C_1$–$C_5$ alkoxy or phenoxy; and m, n and p are numbers of from 0 to 30, the sum of m, n and p being from 1 to 30.

11. The method of claim 10 wherein R is an aliphatic hydrocarbon group containing from 8 to 15 carbon atoms, n and p are 0, m is a number of from 5 to 15 and $R_1$ is chloride.

12. The method of claim 11 wherein R contains from 12 to 15 carbon atoms and m is a number of from 9 to 10.

13. The method of claim 10 wherein the sodium chloride brine has a concentration of from 200 to 305 gpl, and the surfactant is present in the brine in amounts of from 0.5 to 2 weight percent.

14. The method of claim 1 wherein said diaphragm base mat contacted with the aqueous alkali metal halide brine-surfactant mixture has a coating of inorganic particulates.

15. The method of claim 14 wherein the inorganic particulate material is selected from (a) the oxides, borides, carbides, silicates and nitrides of the valve materials, (b) clay minerals, (c) hydrous oxides of the metals iron, zirconium and magnesium and (d) mixtures of such materials.

16. The method of claim 15 wherein the inorganic particulate materials are selected from (a) the oxides of zirconium (b) the clay minerals are selected from kaolin, talc, montmorillonite, illire, attapulgite and hectorite, and (c) the hydrous metal oxides are selected from zirconium and magnesium hydroxides.

17. The method of claim 16 wherein a combination of the inorganic particulate (a), (b) and (c) are used and the weight ratio of (a):(b):(c) is about 1:1:1.

18. A method for forming an electrolyte permeable asbestos-free diaphragm on a foraminous cathode structure for use in a chlor-alkali electrolytic cell comprising:

(a) forming on said cathode structure from a liquid slurry a liquid-permeable diaphragm base mat of asbestos-free material comprising fibrous synthetic polymeric material resistant to the chlor-alkali cell environment and ion exchange material, (b) drawing through said diaphragm base mat a liquid slurry comprising inorganic particulate material dispersed in aqueous alkali metal halide brine containing a wetting amount of surfactant selected from the group consisting of nonionic, anionic and amphoteric surfactants, and mixtures of said surfactants to deposit a coating of inorganic particulate material on said diaphragm base mat, and (c) drying the coated diaphragm at temperatures below the sintering or melting temperature of the synthetic polymeric material.

19. The method of claim 18 wherein the fibrous synthetic polymeric material comprises polytetrafluoroethylene.

20. The method of claim 19 wherein the concentration of alkali metal halide in the brine is from 100 to 315 grams per liter.

21. The method of claim 20 wherein the alkali metal salt is sodium chloride.

22. The method of claim 21 wherein from 0.1 to 5 weight percent of surfactant is present in the brine.

23. The method of claim 22 wherein the surfactant is a nonionic surfactant.

24. The method of claim 23 wherein the nonionic surfactant is represented by the following formula:

$$R—(OC_2H_4)_m—(OC_3H_6)_n—(OC_4H_8)_p—R_1 \quad (1)$$

wherein R is an aliphatic hydrocarbon group containing from 8 to 15 carbon atoms; $R_1$ is hydroxyl, chloride, $C_1$–$C_3$ alkyl, $C_1$–$C_5$ alkoxy or phenoxy; and m, n and p are numbers of from 0 to 30, the sum of m, n and p being from 1 to 30.

25. The method of claim 24 wherein R is an aliphatic hydrocarbon group containing from 8 to 15 carbon atoms, n and p are 0, m is a number of from 5 to 15 and $R_1$ is chloride.

26. The method of claim 22 wherein the surfactant is an amphoteric betaine surfactant.

* * * * *